US007274339B2

(12) United States Patent
Wu et al.

(10) Patent No.: US 7,274,339 B2
(45) Date of Patent: Sep. 25, 2007

(54) DUAL-BAND MULTI-MODE ARRAY ANTENNA

(75) Inventors: Chung-Han Wu, Tainan (TW); Jia-Jiu Song, Taipei (TW)

(73) Assignee: Smartant Telecom Co., Ltd., Hsinchu (TW)

( * ) Notice: Subject to any disclaimer, the term of this patent is extended or adjusted under 35 U.S.C. 154(b) by 62 days.

(21) Appl. No.: 11/227,201

(22) Filed: Sep. 16, 2005

(65) Prior Publication Data

US 2007/0063913 A1 Mar. 22, 2007

(51) Int. Cl.
*H01Q 9/28* (2006.01)

(52) U.S. Cl. ..... 343/795; 343/700 MS; 343/853

(58) Field of Classification Search ..... 343/700 MS, 343/795, 850, 853, 857, 858, 824
See application file for complete search history.

(56) References Cited

U.S. PATENT DOCUMENTS 5,181,044 A * 1/1993 Matsumoto et al. ..... 343/752
5,268,701 A * 12/1993 Smith ..... 343/767
2003/0112200 A1* 6/2003 Marino ..... 343/824
2006/0170593 A1* 8/2006 Watts ..... 343/700 MS
2006/0279463 A1* 12/2006 Milyakh ..... 343/700 MS
2007/0001922 A1* 1/2007 Song et al. ..... 343/795

* cited by examiner

*Primary Examiner*—Hoanganh Le
(74) *Attorney, Agent, or Firm*—Harness, Dickey & Pierce, PLC

(57) ABSTRACT

A dual-band multi-mode array antenna is provided, including an antenna substrate with antenna units each of which having a feeding via; and a conductive substrate connected to the antenna substrate to form an angle in between. The conductive substrate has a symmetric feeding network disposed on a surface of the conductive substrate; and a first ground portion disposed on another surface of the conductive substrate. The symmetric feeding network and the first ground portion are electrically coupled to each of the antenna units through the feeding vias. Moreover, the antenna units are electrically coupled in parallel.

2 Claims, 11 Drawing Sheets

DUAL-BAND MULTI-MODE ARRAY ANTENNA

BACKGROUND

1. Field of Invention

The invention relates to a patch antenna and, in particular, to a double-band multi-mode array antenna.

2. Related Art

The rapid development in wireless communication technology and semiconductor processes in recent years have brought us wireless communication and satellite communication networks, such as satellite positioning systems, direct broadcasting satellites (DBS), mobile satellites (MSAT), wireless phones, wireless area network systems, wireless subscriber exchange machines, wireless area pagers, etc. The wireless communication system is mainly comprised of a transceiver and an antenna. The antenna is the bridge to transceiving electromagnetic signals in air and an indispensable device in the communication system. Currently, the antenna is preferred to be made using printed circuits. It has the advantages of easy production and low cost.

A communication standard commonly used in wireless communications is IEEE802.11a or IEEE802.11b set by the Institute Electrical and Electronic Engineer (IEEE). The IEEE802.11a standard uses the 5 GHz band, and the IEEE802.11b standard uses the 2.4 GHz band. Therefore, the antenna substrate is designed based upon the used band. When the wireless communication system needs to use two different frequencies simultaneously, antennas for the two bands have to be used. This causes a lot of inconvenience. Nowadays, the trend in antenna designs is the dual-band antenna in order to meet the multi-band requirement. Moreover, most electronic devices are designed to be compact and light. The conventional antenna structures are not suitable for such purposes. Therefore, it is an important to minimize the antenna size while keeping the desired antenna functions.

SUMMARY

In view of the foregoing, an object of the invention is to provide a dual-band multi-mode array antenna to solve existing problems in the prior art.

The disclosed dual-band multi-mode array antenna can achieve the goals of minimizing the antenna size and keeping the antenna functions.

To achieve the above object, the dual-band multi-mode array antenna of the invention includes: an antenna substrate and a conductive substrate. The conductive substrate is coupled to the antenna substrate, subtending an angle. The antenna substrate has several antenna units, each of which has a feeding via. The conductive substrate includes a symmetric feeding network and a first ground portion. The symmetric feeding network is disposed on one surface of the conductive substrate, and he first ground portion is disposed on another surface of the conductive substrate. The symmetric feeding network and the first ground portion are electrically coupled to each of the antenna units via the feeding vias, so that the antenna units are electrically coupled in parallel.

The angle between the antenna substrate and the conductive substrate is preferably about 90 degrees. The feeding vias on the antenna units are on a line.

The symmetric feeding network includes: a signal feeding portion and several meander traces. Using the meander traces, each feeding via is electrically coupled to the signal feeding portion. The symmetric feeding network forms its symmetric structure using the signal feeding portion as its center. Therefore, the phase between the signal feeding portion and each antenna unit is about the same.

There are several protruding parts on the side by which the conductive substrate is connected to the antenna substrate. The protruding parts correspond to the feeding vias, respectively. Thus, when assembling the dual-band multi-mode array antenna, the protruding parts are inserted into the corresponding feeding vias to firmly fix the antenna substrate and the conductive substrate.

The antenna unit includes at least one pair of radiation portions and at least one pair of second ground portions. Each radiation portion corresponds to a second ground portion. Both of them are disposed on two surfaces of the antenna substrate. Each radiation portion includes a pair of dual-band radiation unit and a power distribution unit. Each dual-band radiation unit has a first band radiation microstrip and two second band radiation microstrips to radiate the feeding signal fed into the dual-band multi-mode array antenna. The power distribution unit is electrically coupled to the dual-band radiation unit and to the symmetric feeding network via the feeding via. The feeding power of the feeding signal is homogeneously distributed to each dual-band radiation unit. Moreover, each of the second ground portions is symmetric about a radiation portion and includes a pair of dual-band ground unit and a power distribution unit. Each dual-band ground unit has a first band ground microstrip and two second band ground microstrips. The first and second band ground microstrips are symmetric about the first and second band radiation microstrips. The power distribution unit is electrically coupled to the dual-band ground unit and to the first ground portion via the feeding via.

The length of the first band radiation microstrip is greater than that of the second band radiation microstrip. The length of the first band ground microstrip is greater than that of the second band ground microstrip. The power distribution unit has roughly a T-shaped structure. Of the radiation portion, the first band radiation microstrip is coupled to power distribution unit of the radiation portion via a first conductive microstrip. Likewise, of the ground portion, the first band ground microstrip is coupled to the power distribution unit of the ground portion via the first conductive microstrip. The first band ground microstrip is electrically and perpendicularly coupled to the first conductive microstrip, and the first band ground microstrip is electrically and perpendicularly coupled to the first conductive microstrip.

The second band radiation microstrip of the radiation portion can be coupled to the power distribution unit of the radiation portion via the second and third conductive microstrips. Of the ground portion, the second band ground microstrip is also coupled to the power distribution unit of the ground portion via the second and third conductive microstrips. Here the second and third microstrips have a meander path roughly in the shape of a U. Each of the second band radiation microstrips is electrically coupled to the second and third conductive microstrips of the radiation portion in a roughly perpendicular way. Likewise, the second band ground microstrip is electrically coupled to the second and third conductive microstrips in a vertical way. The second band radiation microstrip and the second band ground microstrip coupled to the second conductive microstrip extend in opposite direction (viewing from the connection point of the second conductive microstrip). The second band radiation microstrip and the second band ground microstrip coupled to the third conductive microstrip also extend in opposite directions (viewing from the connection point of the third conductive microstrip).

Besides, the disclosed dual band multi-mode array antenna further includes a reflective plate, which is provided on both sides of the conductive substrate with the antenna substrate, parallel to the antenna substrate, to reflect signals radiated by the antenna unit and increase its pointing nature.

Moreover, the disclosed dual band multi-mode array antenna also includes: a base, a connector disposed on the base, a metal wire, and a shell coupled to the base. One end of the metal wire is electrically coupled to the symmetric feeding network and the first ground portion. The other end is electrically coupled to the connector. The shell covers the antenna substrate, the conductive substrate, and the reflective plate for protecting them.

The reflective plate is formed with a plurality of protruding edges, through which the reflective plate is inserted into a plurality of slots on the base and/or shell, fixing the reflective plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

The conventional array antenna has the antenna pattern and the feeding network pattern formed on the same surface (i.e., on the same substrate). In this invention, the antenna pattern and the feeding network pattern are disposed separately on individual substrates. The two substrates are connected in a crossing way to minimize the planar size of the antenna structure.

Figure 1:
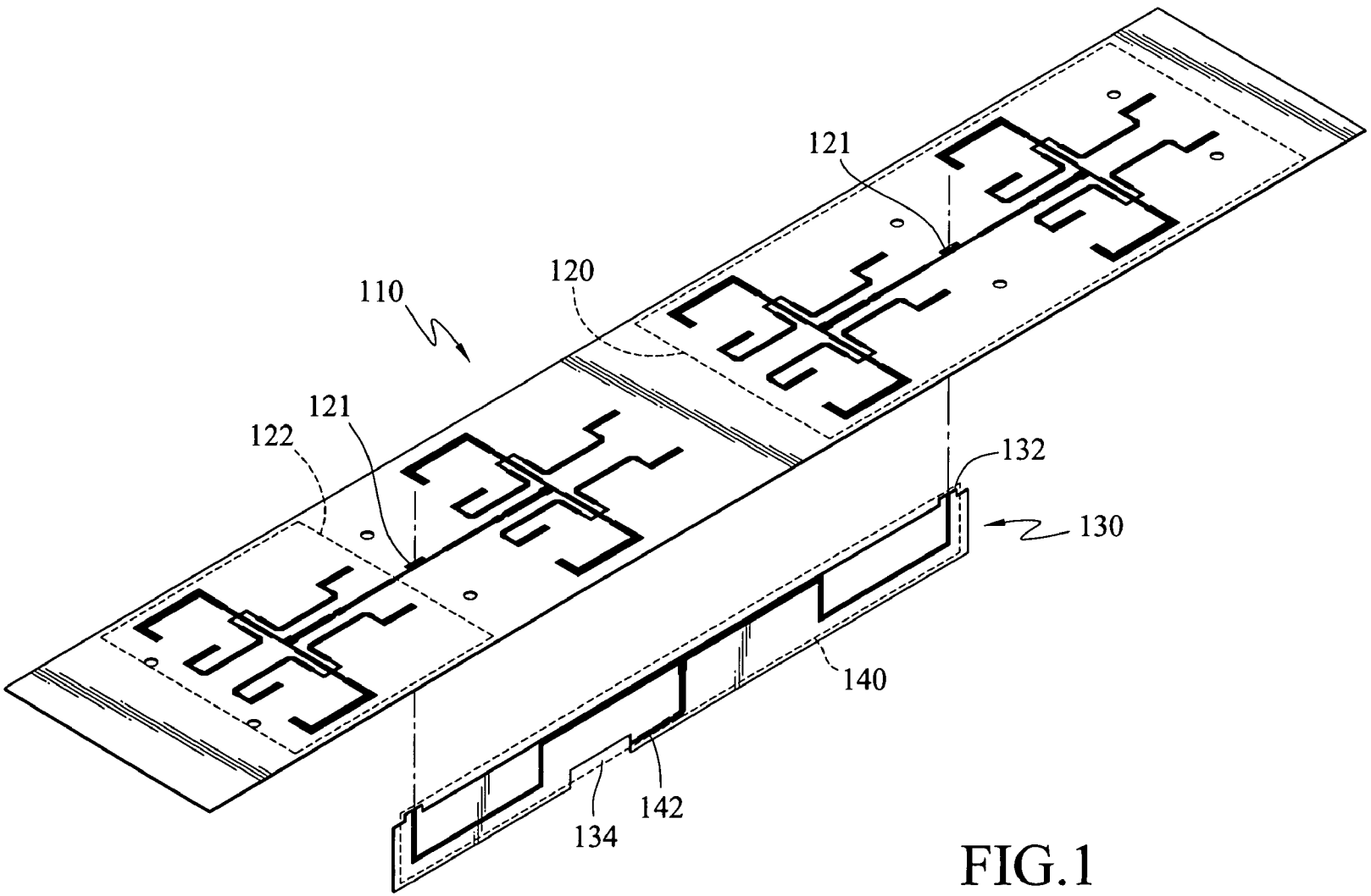
FIG. 1 is the schematic view of a dual-band multi-mode array antenna according to a first embodiment of the invention.

As shown in FIG. 1, the dual-band multi-mode array antenna according to the first embodiment of the invention includes: an antenna substrate 110 and a conductive substrate 130.

The antenna substrate 110 is coupled to the conductive substrate 130 at an angle. The angle is preferably about 90 degrees. That is, the two substrates are roughly perpendicular to each other.

The antenna substrate 110 is provided with a microstrip trace pattern to form a plurality of antenna units 120. Each of the antenna units 120 has a feeding via 121, formed along a line.

One surface of the conductive substrate 130 is provided with a microstrip trace pattern to form a symmetric feeding network 140. The symmetric feeding network 140 is electrically coupled to the antenna units 120 via the feeding vias 121, so that the antenna units 120 are coupled in parallel. The symmetric feeding network 140 has a signal feeding portion 142, about which the symmetric structure is formed.

Moreover, the signal feeding portion has distinct meander traces to the feeding vias 121, so that the phases of the signals at the antenna units 120 are the same. In this case, the field pattern is optimized. Besides, the widths of the meander trace can be adjusted (increased or decreased) to obtain the required impedance.

Another surface of the conductive substrate 130 is provided with a first ground portion (not shown), distributed all over the surface. Nevertheless, the first ground portion may be formed corresponding to the symmetric feeding network 140. That is, the first ground portion is formed on the other surface corresponding to the position and pattern of the symmetric feeding network 140. The symmetric feeding network 140 overlaps with and sits inside the first ground portion. In other words, the area of each part of the first ground portion is larger than the corresponding part of the symmetric feeding network 140.

In this case, the material of the antenna substrate 110 and the conductive substrate 130 may be glass fiber or some similar substance. In particular, a protruding edge 132 is formed on the side of the conductive substrate 130 by which it is connected to the antenna substrate, corresponding to each of the feeding vias 121. When assembling the antenna, the protruding edges 132 are inserted into the feeding vias 121, so that the antenna substrate 110 and the conductive substrate are firmly connected.

Each antenna unit 120 includes a pair of radiation portions 122 and a pair of second ground portions (now shown). The radiation portions 122 and the second ground portions are formed on two surfaces of the antenna substrate 110. More explicitly, the radiation portions 122 is formed on the top surface of the antenna substrate 110 (that is, on a different side of the antenna substrate 110 from the conductive substrate), and the second ground portions are formed on the bottom surface of the antenna substrate 110 (that is, on the same side of the antenna substrate 110 as the conductive substrate).

Figure 2A:
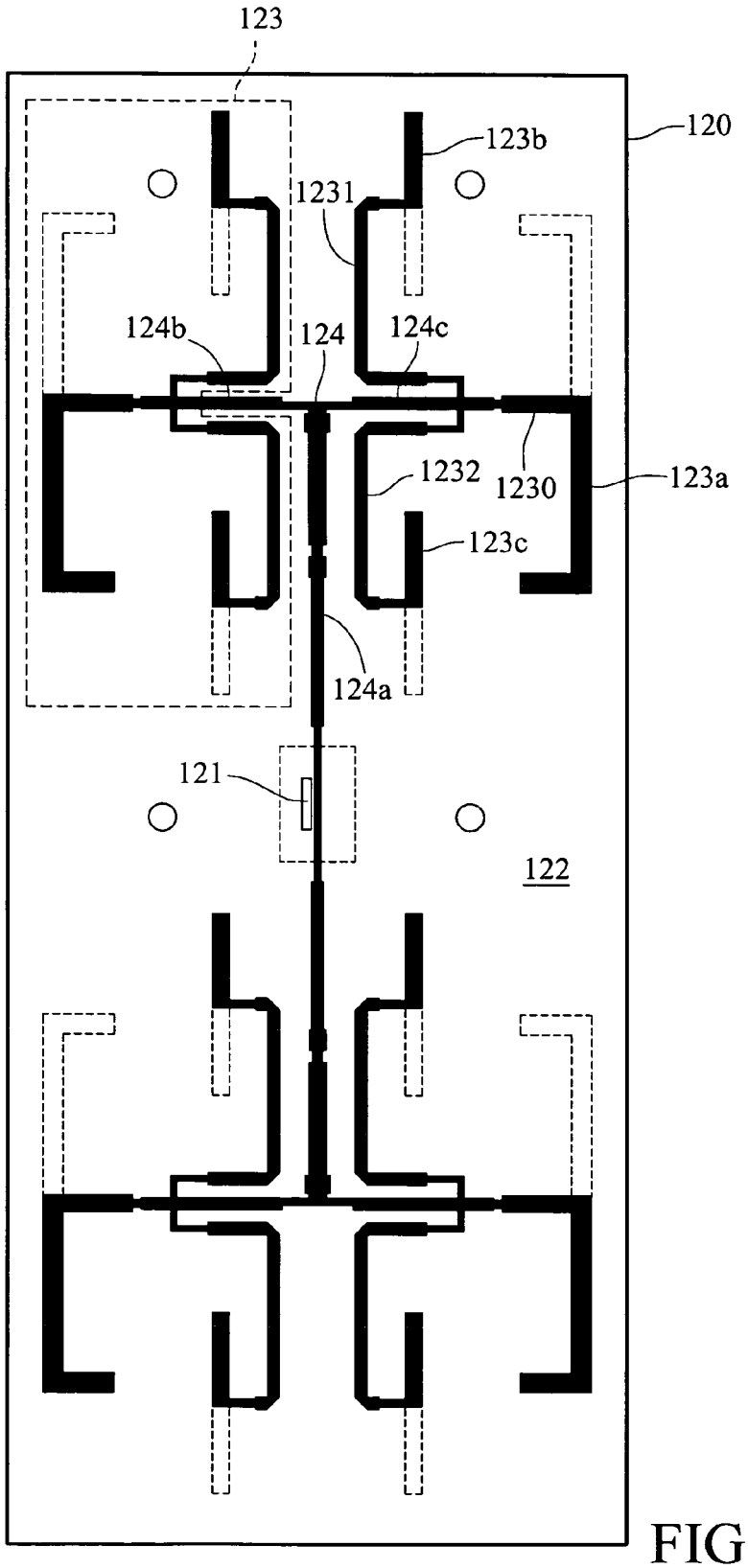
FIG. 2A is the schematic view of one surface of the antenna unit in FIG. 1, where a microstrip trace pattern of the radiation portion is formed.

With reference to FIG. 2A, one surface of the antenna unit in FIG. 1 has a microstrip trace pattern of the radiation portions. Each radiation portion 122 has a dual-band radiation unit 123 and a power distribution unit 124 disposed symmetrically. The dual-band radiation unit 123 has a first band radiation microstrip 123*a* and second band radiation microstrips 123*b*, 123*c* disposed symmetrically.

The first band radiation microstrip 123*a* (e.g., 2.4 GHz) is electrically and perpendicularly coupled to one end of a first microstrip line 1230. The second band radiation microstrip 123*b* (e.g., 5 GHz) is electrically and perpendicularly coupled to one end of a second microstrip line 1231. The second microstrip line 1231 has a meander path, roughly in a U shape. The second band radiation microstrip 123*c* is electrically and perpendicularly coupled to one end of a third microstrip line 1232. The third microstrip line 1232 has a meander path, roughly in a U shape. The third microstrip line 1232 and the second microstrip line 1231 are disposed symmetrically.

Besides, the first band radiation microstrip 123*a* extends in the opposite direction of the second band radiation microstrips 123*b*, 123*c*. If the first band radiation microstrip 123*a* extends toward the side of the antenna substrate 110, then the second band radiation microstrips 123*b*, 123*c* extend toward the other side of the antenna substrate 110. (Here we take as the reference point the end where the microstrips are coupled to the microstrip lines.)

The power distribution unit 124 is coupled to the first band radiation microstrip 123*a* and the second band radiation microstrips 123*b*, 123*c* via the first microstrip line 1230, the second microstrip line 1231, and the third microstrip line 1232 for evenly distributing the feeding power of the feeding signal to each of the connected dual-band radiation units 123. The power distribution unit 124 is roughly in a T shape. Two side arms 124*b*, 124*c* of the power distribution unit 124 are electrically coupled to a dual-band radiation unit 123, respectively. The terminal 124*a* of the power distribution unit 124 is electrically coupled to the terminal of the power distribution unit of another radiation portion (not shown), constituting a complete antenna pattern. The radio signal enters from the terminal 124*a* of the power distribution unit 124 is electrically coupled to the symmetric feeding network (not shown) via the feeding via 121.

In this embodiment, the extension direction of the terminal 124*a* of the power distribution unit 124 is the same as or opposite to that of the second band radiation microstrip 123*c* according to the practical needs of antenna designs.

Figure 2B:
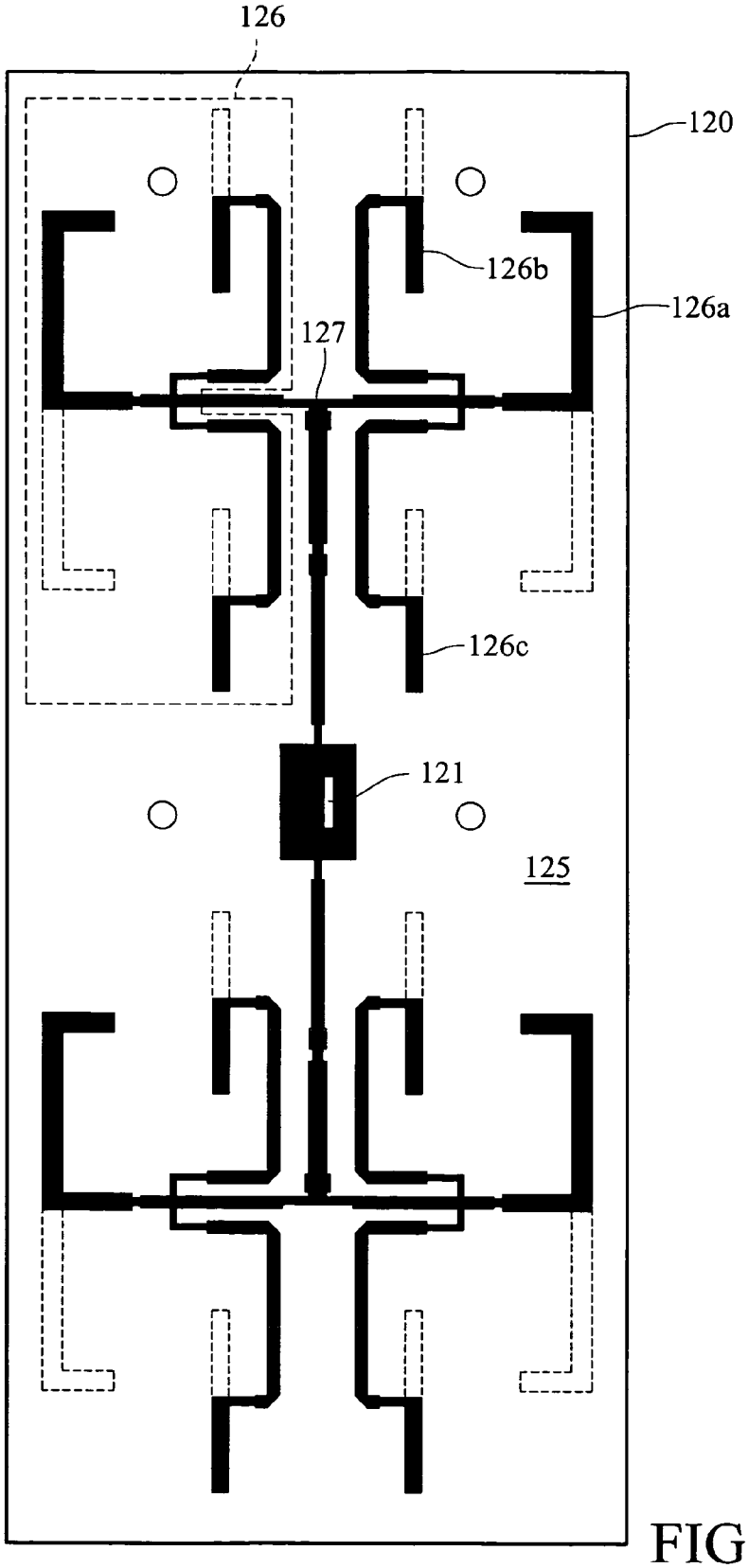
FIG. 2B is the schematic view of another surface of the antenna unit in FIG. 1, where a microstrip trace pattern of the second ground portion is formed.

With reference to FIG. 2B, another surface of the antenna unit in FIG. 1 has the microstrip trace pattern of the second ground portion. The second ground portion 125 also has symmetric dual-band ground unit 126 and power distribution unit 127. The microstrip trace pattern on the second ground portion 125 is symmetric about the microstrip trace pattern of the radiation portion 122 on another surface. That is, the first band radiation microstrip 123*a*, the second band radiation microstrips 123*b*, 123*c* extend in the opposite direction to that of the first band ground microstrip 126*a*, the second band ground microstrips 126*b*, 126*c*. The antenna patterns are symmetric. The two side arms of the power distribution unit 127 are electrically coupled to a dual-band ground unit, respectively. The terminal of the power distribution unit 127 is electrically coupled to the terminal of the power distribution unit of another second ground portion, constituting a complete antenna pattern. Here the terminal of the power distribution unit 127 is also electrically coupled to the first ground portion (not shown) of the conductive substrate via the feeding via 121.

Although we use an antenna unit with only a pair of radiation portions and a pair of second ground portions symmetric about the radiation portion to explain the invention, the antenna unit may have two or more pairs of radiation portions and second ground portions. In those cases, the antenna pattern is as described above. Each radiation portion is symmetric about a second ground portion.

Figure 3:
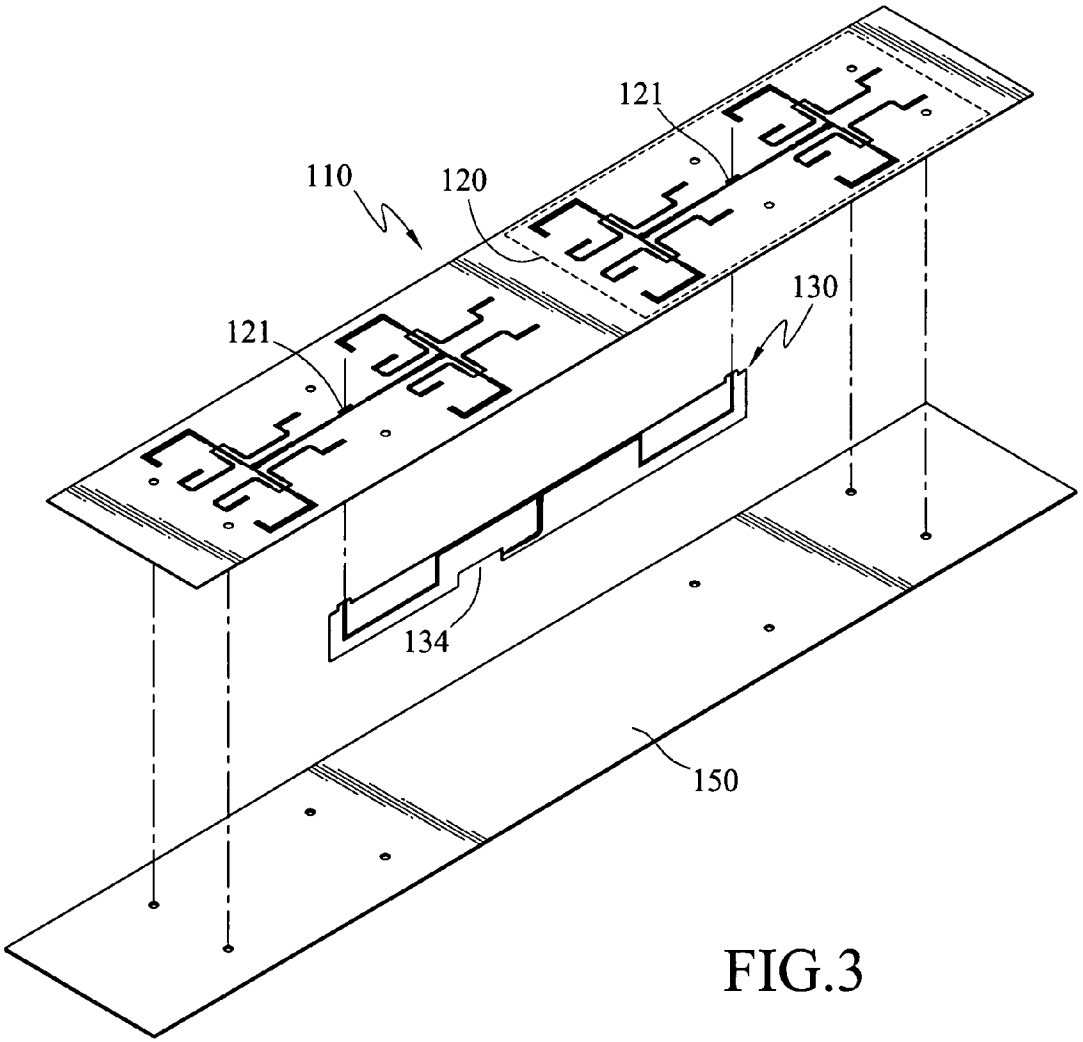
FIG. 3 is the schematic view of a dual-band multi-mode array antenna according to a second embodiment of the invention.

Moreover, the antenna unit may include a reflective plate 150, as shown in FIG. 3. The reflective plate 150 is parallel to the antenna substrate 110 and located on the side of the conductive substrate 130 opposite to the antenna substrate 110. That is, the reflective plate 150 and the antenna substrate 110 are on two opposite sides of the antenna substrate 110. The reflective plate 150 is a planar plate made of a metal. It utilizes the fact that the metal has a shielding effect on electromagnetic waves to reflect the radiation signal generated by the antenna unit 120 to a specific direction. This increases the orientation gain of the antenna.

Figure 4:
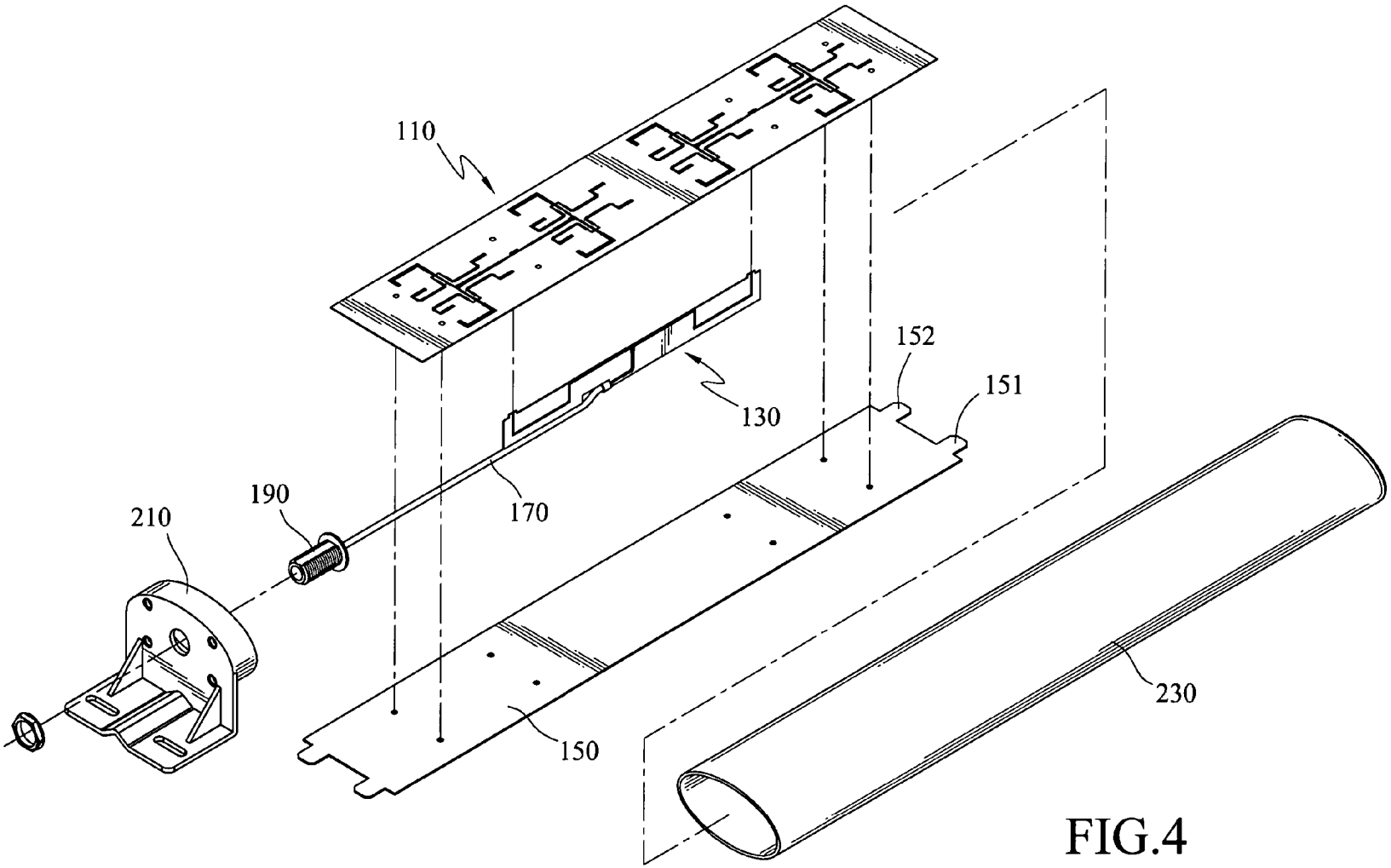
FIG. 4 is the three-dimensional exploded view of a dual-band multi-mode array antenna according to a third embodiment of the invention.

Beside, the antenna unit also includes: a metal wire 170, a connector 190, a base 210, and a shell 230, as shown in FIG. 4.

Both ends of the reflective plate 150 have two protruding edges 151, 152 to be inserted into the slots on the base 210 and the shell 230. This fixes the reflective plate 150.

The base 210 has roughly an L shape to be fixed on a supporting frame (not shown). The base 210 has a connector 190. One end of the connector 190 is electrically coupled to the signal feeding portion 142 of the conductive substrate 130 via the metal wire 170. The other end of the connector 190 is coupled to an electronic device (not shown). In particular, the terminal of the signal feeding portion 142 of the conductive substrate 130 is formed with an opening 134. When the signal feeding portion 142 is electrically coupled to the metal wire 170, the metal wire 170 can be conveniently disposed in the opening 134.

The shell 230 may be connected to the base 210 for covering the antenna substrate 110, the conductive substrate 130, and the reflective plate 150. It serves the purpose of protecting the antenna substrate 110, the conductive substrate 130, and the reflective plate 150. As shown in FIG. 4, the base 210 and the shell 230 combine to form a sealed object to cover the antenna substrate 110, the conductive substrate 130, and the reflective plate 150.

Figure 5A:
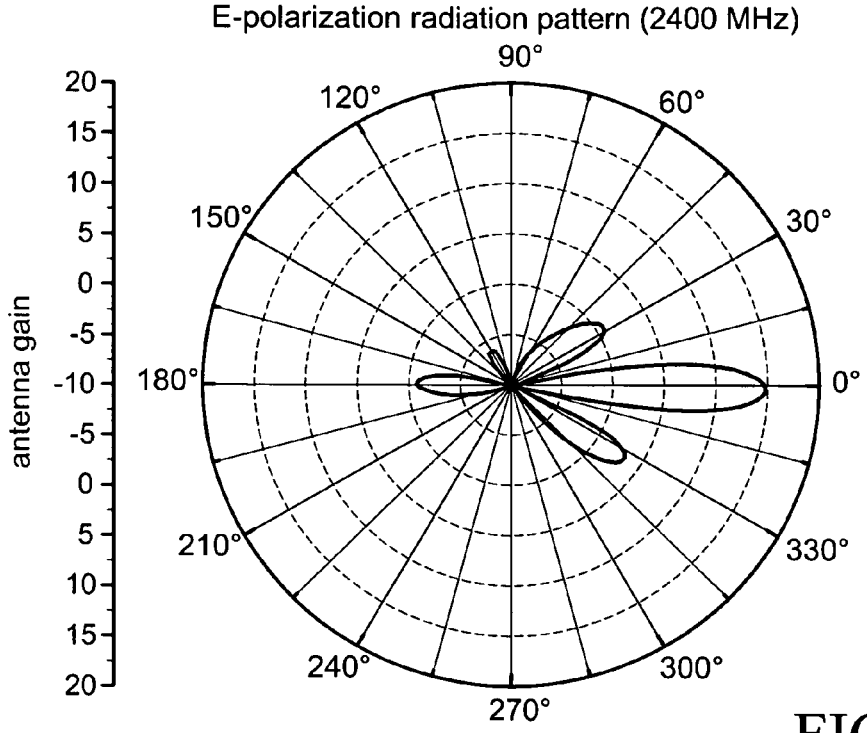
FIGS. 5A-5C shows the E-polarization radiation pattern in the first band.
Figure 5B:
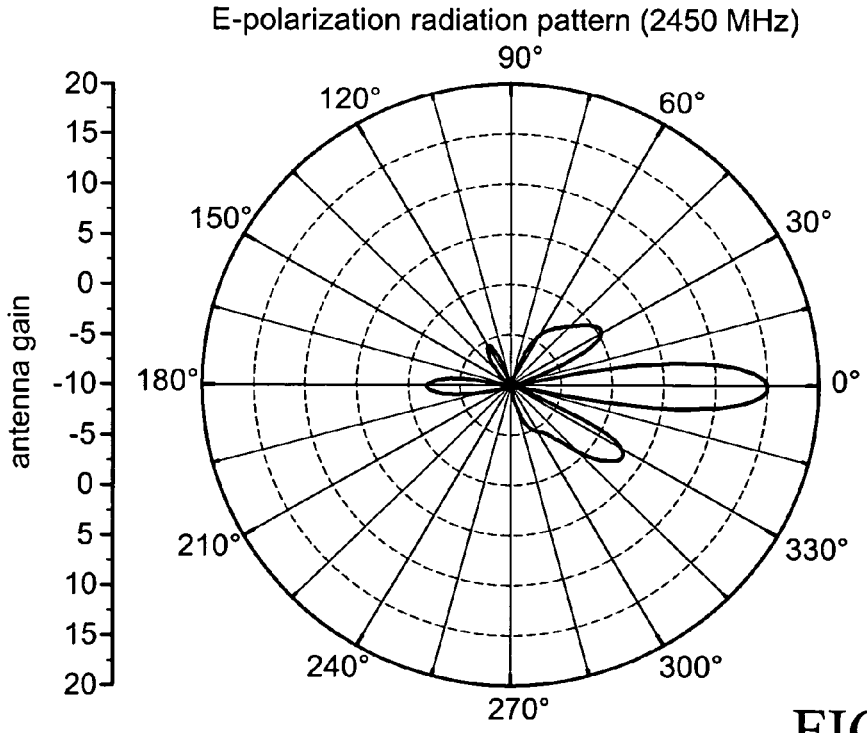
Figure 5C:
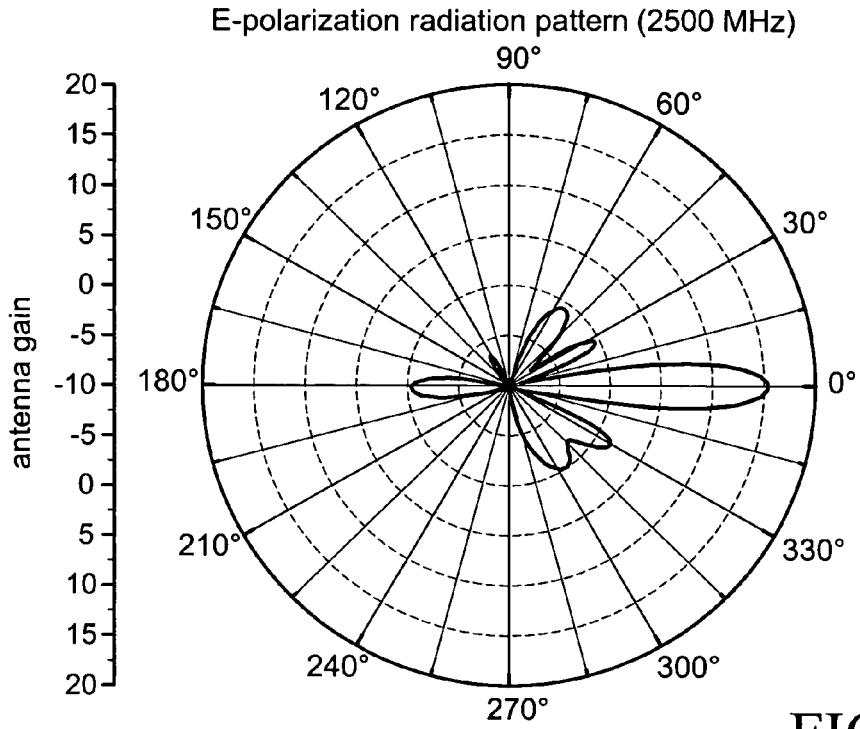
Figure 5D:
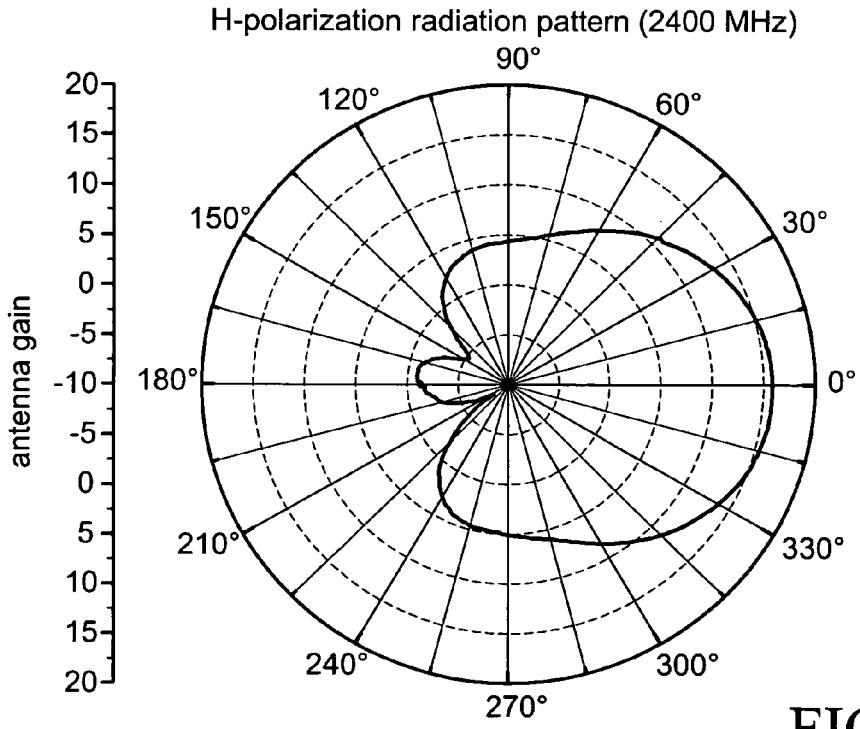
FIGS. 5D-5F shows the H-polarization radiation pattern in the first band.
Figure 5E:
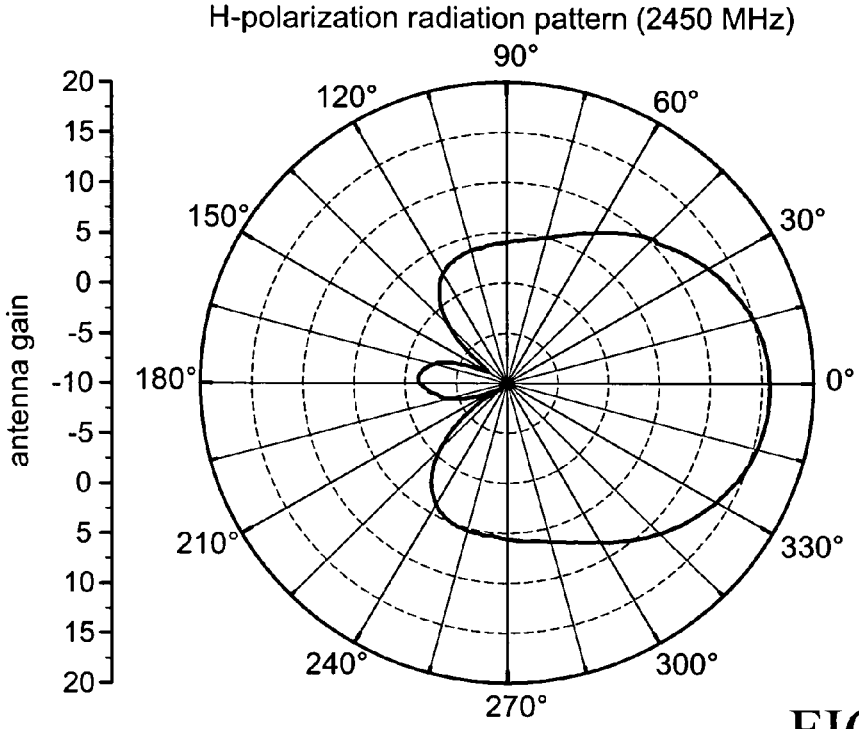
Figure 5F:
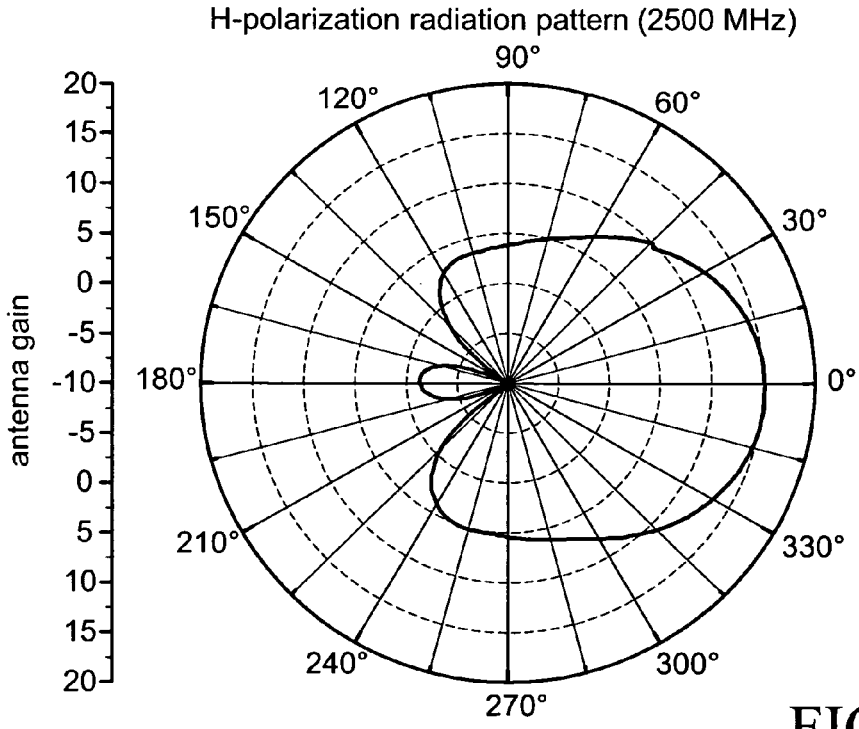
Figure 6A:
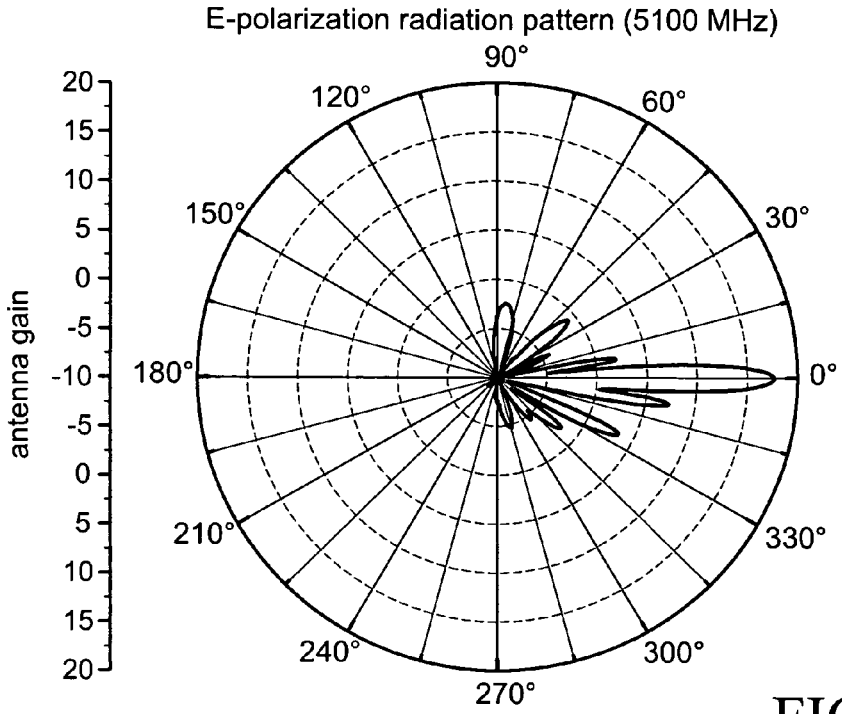
FIGS. 6A-6C shows the E-polarization radiation pattern in the second band.
Figure 6B:
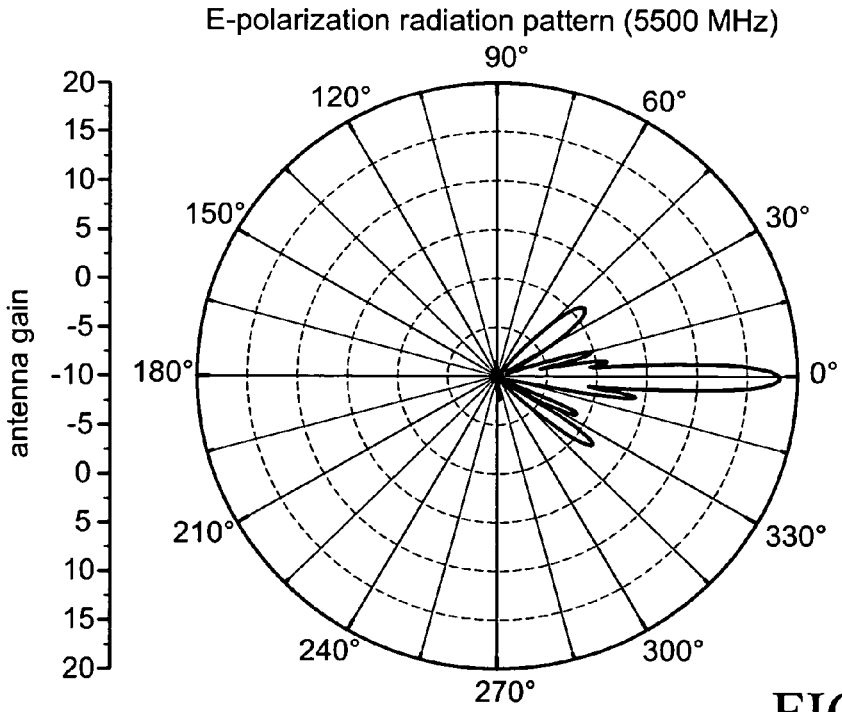
Figure 6C:
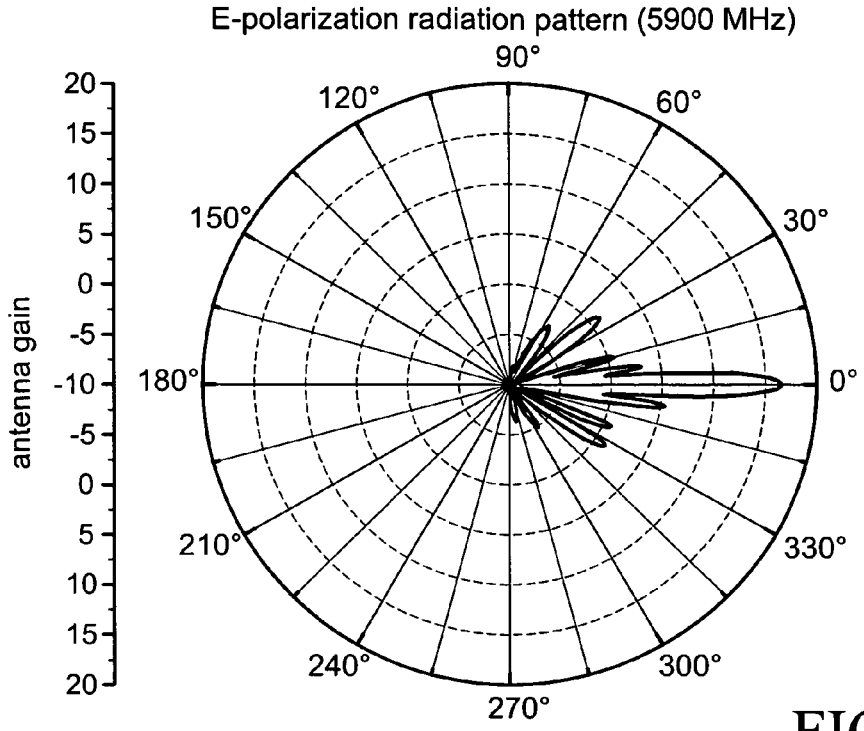
Figure 6D:
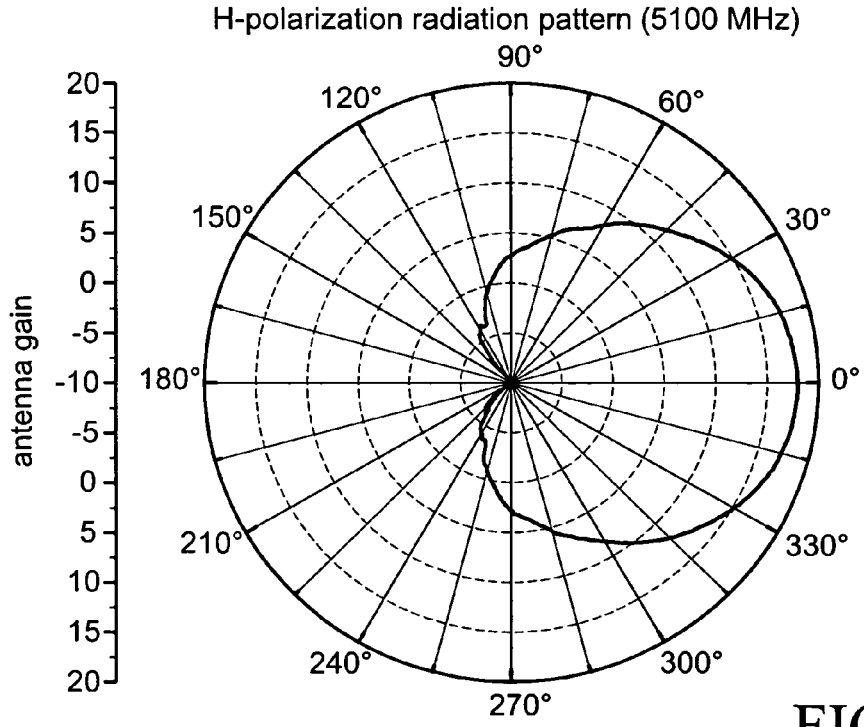
FIGS. 6D-6F shows the H-polarization radiation pattern in the second band.
Figure 6E:
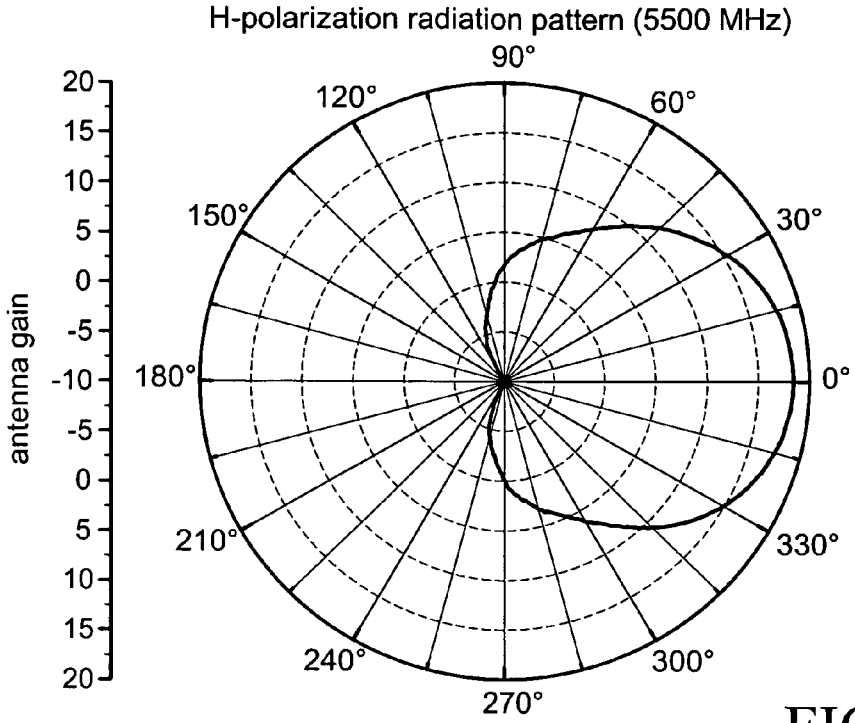
Figure 6F:
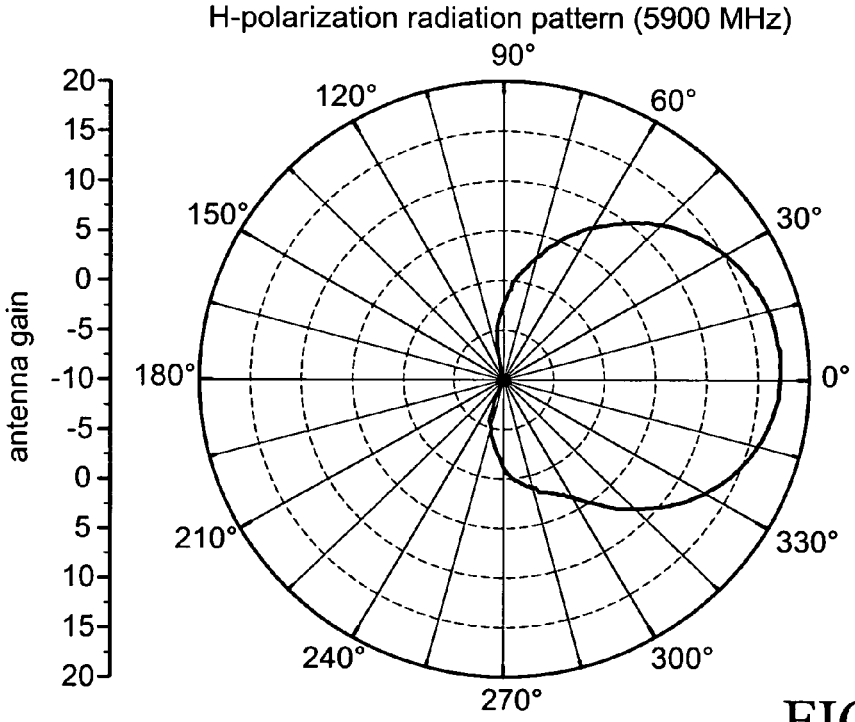

The invention further provides the radiation field patterns obtained in actual tests. We vary the frequency of the first band among 2.4 GHz, 2.45 GHz, and 2.5 GHz and the frequency of the second band among 5.1 GHz, 5.5 GHz, and 5.9 GHz. Please refer to FIGS. 5A-5C for the E-polarization radiation pattern in the first band; to FIGS. 5D-5F for the H-polarization radiation pattern in the first band; to FIGS. 6A-6C for the E-polarization radiation pattern in the second band; to FIGS. 6D-6F for the H-polarization radiation pattern in the second band.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dual-band multi-mode array antenna, comprising:

an antenna substrate, which has a plurality of antenna units, each of which has a feeding via;

a conductive substrate, which is coupled to the antenna substrate at an angle and includes: a symmetric feeding network disposed on the surface of the conductive substrate; a first ground portion disposed on another surface of the conductive substrate; a reflective plate disposed on a side of the conductive substrate opposite to the antenna substrate and parallel to the antenna substrate, for reflecting the feeding signal radiated from the antenna unit, thereby increasing an orientation nature of the dual-band multi-mode array antenna;

a base;

a connector disposed on the base;

a metal wire, one end of which is electrically coupled to the symmetric feeding network and the first ground portion, and the other end of which is electrically coupled to the connector; and a shell connected to the base, for covering the antenna substrate, the conductive substrate, and the reflective plate, thereby protecting the antenna substrate, the conductive substrate, and the reflective plate;

wherein the symmetric feeding network and the first ground portion are electrically coupled to the antenna units via the feeding visa so that the antenna units are electrically coupled in parallel.

2. The dual-band multi-mode array antenna of claim 1, wherein the reflective plate has a plurality of protruding edges for insertion into a plurality of corresponding slots on at least one of the base and the shell, thereby fixing the reflective plate.

* * * * *